US005827590A

United States Patent [19]

Morita et al.

[11] Patent Number: 5,827,590

[45] Date of Patent: Oct. 27, 1998

[54] THERMOSENSITIVE RECORDING ADHESIVE LABEL SHEET

[75] Inventors: Mitsunobu Morita; Tomohisa Kakuda; Norihiko Inaba; Shinobu Miyauchi, all of Numazu; Mitsuru Naruse, Shimizumachi, all of Japan

[73] Assignee: Ricoh Company, Ltd., Tokyo, Japan

[21] Appl. No.: 710,716

[22] Filed: Sep. 20, 1996

[30] Foreign Application Priority Data

| | | | |
|---|---|---|---|
| Sep. 21, 1995 | [JP] | Japan | 7-243015 |
| Oct. 30, 1995 | [JP] | Japan | 7-281580 |
| Sep. 17, 1996 | [JP] | Japan | 8-244862 |

[51] Int. Cl.[6] ..... B41M 5/40

[52] U.S. Cl. ..... 428/40.1; 283/81; 428/41.6; 428/41.7; 428/199; 428/204; 428/207; 428/537.5; 428/913; 503/200; 503/226

[58] Field of Search ..... 428/40.1, 41.6, 428/41.7, 199, 204, 207, 913, 537.5; 283/81; 503/226, 200

[56] References Cited

U.S. PATENT DOCUMENTS

| | | | |
|---|---|---|---|
| 5,326,684 | 7/1994 | Aotsuka | 430/617 |
| 5,409,881 | 4/1995 | Mori et al. | 503/207 |

FOREIGN PATENT DOCUMENTS

| | | |
|---|---|---|
| 0 414 229 | 2/1991 | European Pat. Off. . |
| 0 559 525 | 9/1993 | European Pat. Off. . |
| 2 698 320 | 5/1994 | France . |
| 39 42 692 | 7/1990 | Germany . |
| 62-197483 | 9/1987 | Japan . |
| 2 094 496 | 9/1982 | United Kingdom . |

*Primary Examiner*—Nasser Ahmad
*Attorney, Agent, or Firm*—Oblon, Spivak, McClelland, Maier & Neustadt, P.C.

[57] ABSTRACT

A thermosensitive recording adhesive label sheet has a support, a thermosensitive recording layer provided on the front side of the support, containing a leuco dye serving as a coloring agent and a color developer capable of inducing color formation in the leuco dye upon application of heat thereto, a protective layer provided on the thermosensitive recording layer, containing a binder agent, a pigment and a lubricant, an adhesive layer provided on the back side of the support, opposite to the side of the thermosensitive recording layer with respect to the support, and a disposable backing sheet which is made from a neutral paper and attached to the adhesive layer; with the lubricant for use in the protective layer including an aliphatic acid metallic salt in an amount of 2 wt. % or less of the total solid content of the protective layer.

14 Claims, No Drawings

THERMOSENSITIVE RECORDING ADHESIVE LABEL SHEET

BACKGROUND OF THE INVENTION

1. Field of the Invention

The present invention relates to a thermosensitive recording adhesive label sheet comprising a support, a thermosensitive recording layer formed on the front side of the support, comprising an electron donating coloring compound (leuco dye) serving as a coloring agent and an electron accepting compound serving as a color developer, a protective layer formed on the thermosensitive recording layer, an adhesive layer provided on the back side of the support, and a disposable backing sheet attached to the adhesive layer. In the present invention, a neutral paper is used for the above-mentioned disposable backing sheet.

2. Discussion of the Background

There is conventionally known a thermosensitive recording paper which comprises a sheet-shaped support and a thermosensitive recording layer formed thereon, comprising a leuco dye and a color developer capable of inducing color formation in the leuco dye upon application of heat thereto. Further, it is proposed to utilize such a thermosensitive recording paper as a package label. Since printing can be carried out on the above-mentioned thermosensitive recording label sheet by using a thermal head, images can be printed more sharply and more easily as compared with the case where a conventional ink or ink ribbon is used for image printing.

In view of the environmental problems, there is a tendency for a paper-maker to substitute a neutral paper for an acidic paper. In addition to the above, recycling of used papers is actively carried out these days. In the preparation of the thermosensitive recording adhesive label sheet, it is desired to use a neutral paper as a disposable backing sheet of the label sheet under such circumstances. However, the material control is difficult in the course of the making of neutral paper when lot of used papers are contained in the paper material.

There are many proposals for the thermosensitive recording adhesive label sheet comprising an adhesive layer and a disposable backing sheet on the back side of a support which bears thereon a thermosensitive recording layer, for example, in Japanese Laid-Open Patent Applications 61-41594 and 59-162087. Those proposals relate to improvements in the adhesive layer or an undercoat layer interposed between the support and the adhesive layer. There is no proposal that lays a stress upon the use of a neutral paper for the disposable backing sheet.

An acidic paper is conventionally used as a base paper of the disposable backing sheet. However, the acidic paper has the drawback that deterioration is unavoidable during a long-term storage. In addition, rosin is used as a sizing agent and alumina sulfate is used for fixing the sizing agent in the course of making of the acidic paper, which causes an environmental problem.

To make neutral paper, there are employed neutral sizing agents such as a petroleum resin, a styrene based resin, a higher alcohol, an alkenylsuccinic acid anhydride, and an alkyl ketene dimer; and a variety of cationic polymers, such as polyamide, acrylamide, and cationic starch are used to fix the above-mentioned neutral sizing agents to paper material. Therefore, the neutral paper can be made under the moderate conditions as compared with the conditions for the manufacture of the acidic paper.

In the course of the preparation of neutral paper, various pigments such as clay, talc, calcium carbonate and titanium oxide are internally added to the paper material to improve the whiteness degree and the opacity of the obtained neutral paper. In particular, calcium carbonate is widely employed because it is most effective for improving the long-term storage stability of the neutral paper.

The thermosensitive recording adhesive label sheet is commonly stored in such a fashion that it is turned over and over on itself without pressing it flat, with the result that the disposable backing sheet portion comes in pressure contact with the protective layer portion put thereunder. In the case where the thermosensitive recording adhesive label sheet comprising a disposable backing sheet made from neutral paper is stored under the above-mentioned condition for an extended period of time, there is the drawback that the image density is lowered when printing operation is carried out after storage. This problem occurs when the support of the label sheet also comprises a sheet of neutral paper.

The reason for this has not yet been clarified, but it is supposed that somehow calcium contained in the neutral paper is allowed to react with an aliphatic acid metallic salt contained as a lubricant in the protective layer and the interaction therebetween has an adverse effect on the image density. The amount of calcium contained in the disposable backing sheet becomes larger than expected especially when the disposable backing sheet comprises a neutral paper made from the materials of used papers. The calcium in the form of an ion migrates from the disposable backing sheet and moves throughout the thermosensitive recording adhesive label sheet. When the calcium ion reaches the protective layer of the label sheet, the calcium ion is allowed to react with the aliphatic acid metallic salt for use in the protective layer.

SUMMARY OF THE INVENTION

Accordingly, an object of the present invention is to provide a thermosensitive recording adhesive label sheet which is free from the conventional shortcomings, and capable of producing therein clear images with a sufficiently high image density even though a neutral paper is used for the disposable backing sheet of the label.

The above-mentioned object of the present invention can be achieved by a thermosensitive recording adhesive label sheet comprising (i) a support, (ii) a thermosensitive recording layer provided on the front side of the support, comprising a leuco dye serving as a coloring agent and a color developer capable of inducing color formation in the leuco dye upon application of heat thereto, (iii) a protective layer provided on the thermosensitive recording layer, comprising a binder agent, a pigment and a lubricant comprising an aliphatic acid metallic salt, (iv) an adhesive layer provided on the back side of the support, opposite to the side of the thermosensitive recording layer with respect to the support, and (v) a disposable backing sheet attached to the adhesive layer, comprising a neutral paper; with the protective layer comprising the aliphatic acid metallic salt in an amount of 2 wt. % or less of the total solid content of the protective layer.

In this case, it is preferable that the neutral paper for use in the disposable backing sheet comprise calcium at a concentration of 1,000 ppm or less.

Furthermore, in the above-mentioned thermosensitive recording adhesive label sheet, a calcium-ion-trapping agent capable of trapping calcium ion which migrates from the disposable backing sheet to the protective layer may be contained in the protective layer or the thermosensitive recording layer. Further, an intermediate layer may be provided between the support and the thermosensitive recording layer, and an undercoat layer may be provided between the support and the adhesive layer, and the calcium-ion-trapping agent may be contained in such layers.

In the present invention, a sheet of neutral paper may be used for the support. In this case, it is also preferable that the neutral paper with a calcium concentration of 1,000 ppm or less be used for the support.

DESCRIPTION OF THE PREFERRED EMBODIMENTS

In a thermosensitive recording adhesive label sheet according to the present invention, a thermosensitive recording layer formed on the front side of the support comprises a leuco dye serving as a coloring agent and a color developer.

Any conventional leuco dyes used in this kind of thermosensitive recording material can be used alone or in combination. For example, triphenylmethane leuco compounds, fluoran leuco compounds, phenothiazine leuco compounds, auramine leuco compounds, spiropyran leuco compounds, and indolinophthalide leuco compounds are preferably employed. Specific examples of those leuco dyes are as follows:

3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-di-n-butylamino-7-(o-chloroanilino)fluoran,
3-N-methyl-N,n-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)-fluoran, benzoyl leuco methylene blue,
6'-chloro-8'-methoxy-benzoindolino-spiropyran,
6'-bromo-8'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-(N-ethyl-N-tetrahydrofurfuryl)amino-6-methyl-7-anilinofluoran,
3-N-ethyl-N-(2-ethoxypropyl)amino-6-methyl-7-anilinofluoran,
3-N-methyl-N-isobutyl-6-methyl-7-anilinofluoran,
3-morphorino-7-(N-propyl-trifluoromethylanilino)fluoran,
3-pyrrolidino-m-7-trifluoromethylanilinofluoran,
3-diethylamino-5-chloro-7-(N-benzyl-trifluoromethylanilino)fluoran
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-(N-methyl-N-isopropylamino)-6-methyl-7-anilinofluoran,
3-di-n-butylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-diethylamino-6-methyl-7-mesidino-4', 5'-benzofluoran,
3-N-methyl-N-isopropyl-6-methyl-7-anilinofluoran,
3-N-ethyl-N-isoamyl-6-methyl-7-anilinofluoran,
3-diethylamino-6-methyl-7-(2',4'-dimethylanilino)fluoran,
3-(p-dimethylaminophenyl)-3-[1,1-bis(p-dimethylaminophenyl)ethylene-2-yl]phthalide,
3-(p-dimethylaminophenyl)-3-[1,1-bis(p-dimethylaminophenyl)ethylene-2-yl]-6-dimethylaminophthalide,
3-(p-dimethylaminophenyl)-3-(1-p-dimethylaminophenyl-1-phenylethylene-2-yl)phthalide,
3-(p-dimethylaminophenyl)-3-(1-p-dimethylaminophenyl-1-p-chlorophenylethylene-2-yl)-6-dimethylaminophthalide,
3-(4'-dimethylamino-2'-methoxy)-3-(1"-p-dimethylaminophenyl-1"-p-chlorophenyl-1",3"-butadiene-4"-yl)benzophthalide,
3-(4'-dimethylamino-2'-benzyloxy)-3-(1"-p-dimethylaminophenyl-1"-phenyl-1",3"-butadiene-4"-yl)-benzophthalide,
3-dimethylamino-6-dimethylamino-fluorene-9-spiro-3'-(6'-dimethylamino)phthalide,
3,3-bis-[2-(p-dimethylaminophenyl)-2-(p-methoxyphenyl)ethenyl]-4,5,6,7-tetrachlorophthalide,
3-bis[1,1-bis(4-pyrrolidinophenyl)ethylene-2-yl]5,6-dichloro-4,7-dibromophthalide,
bis(p-dimethylaminostyryl)-1-naphthalenesulfonylmethane, and
bis(p-dimethylaminostyryl)-1-p-tolylsulfonylmethane.

As the color developer for use in the thermosensitive recording layer, various electron accepting compounds, such as phenolic compounds, thiophenolic compounds, thiourea derivatives, and organic acids and metallic salts thereof are preferably employed. Those color developers can be used alone or in combination.

Specific examples of the color developer are as follows:

4,4'-isopropylidenediphenol,
4,4'-isopropylidenebis(o-methylphenol),
4,4'-sec-butylidenebisphenol,
4,4'-isopropylidenebis(o-tert-butylphenol), zinc p-nitrobenzoate,
1,3,5-tris(4-tert-butyl-3-hydroxy-2,6-dimethylbenzyl)-isocyanuric acid,
2,2-(3,4'-dihydroxydiphenyl)propane,
bis(4-hydroxy-3-methylphenyl)sulfide,
4-[β-(p-methoxyphenoxy)ethoxy]salicylic acid,
1,7-bis(4-hydroxyphenylthio)-3,5-dioxaheptane, 1,5-bis(4-hydroxyphenylthio)-5-oxapentane,
4,4'-cyclohexylidenediphenol,
4,4'-isopropylidenebis (2-chlorophenol),
2,2'-methylenebis(4-methyl-6-tert-butylphenol),
4,4'-butylidenebis(6-tert-butyl-2-methyl)phenol,
1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methyl)phenol,
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,3-bis(4-hydroxyphenylthio)-propane,
N,N'-diphenylthiourea,
N,N'-di(m-chlorophenyl)thiourea,
salicylanilide,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
2,2-diallyl-4,4'-diphenolsulfone,
3,4-dihydroxyphenyl-4'-methyldiphenylsulfone,
zinc salt of 1-acetyloxy-2-naphthoic acid,
zinc salt of 2-acetyloxy-1-naphthoic acid,
zinc salt of 2-acetyloxy-3-naphthoic acid,
α,α-bis(4-hydroxyphenyl)-α-methyltoluene,
antipyrine complex of zinc thiocyanate,
tetrabromobisphenol A,
tetrabromobisphenol S,
4,4 '-thiobis(2-methylphenol), and
4,4'-thiobis(2-chlorophenol).

It is preferable that the amount of the color developer be in the range of 1 to 20 parts by weight, more preferably in the range of 2 to 10 parts by weight, to one part by weight of the leuco dye serving as the coloring agent.

To provide the thermosensitive recording layer on the support, a variety of conventional binder agents may be employed in the thermosensitive recording layer for binding the above-mentioned leuco dyes and color developers to the support. Any conventional binder agents used in the conventional thermosensitive recording materials can appropriately be employed.

Examples of the binder agent for use in the thermosensitive recording layer are water-soluble polymers such as polyvinyl alcohol, starch and starch derivatives, cellulose derivatives such as methoxy cellulose, hydroxyethyl cellulose, carboxymethyl cellulose, methyl cellulose and ethyl cellulose, sodium polyacrylate, polyvinyl pyrrolidone, acrylamide—acrylic ester copolymer, acrylamide—acrylic ester—methacrylic acid terpolymer, alkali salts of styrene—maleic anhydride copolymer, alkali salts of isobutylene—maleic anhydride copolymer, polyacrylamide, sodium alginate, gelatin, and casein; emulsions such as polyvinyl acetate, polyurethane, polyacrylic ester, polymethacrylic ester, vinyl chloride—vinyl acetate copolymer, and ethylene—vinyl acetate copolymer; and latexes such as styrene—butadiene—acrylic copolymer.

The thermosensitive recording layer may further comprise a variety of thermofusible materials to improve the thermal sensitivity.

Specific examples of the above-mentioned thermofusible material are as follows: p-benzylbiphenyl, terphenyl, triphenylmethane, benzyl p-benzyloxybenzoate, β-benzyloxy naphthalene, phenyl β-naphthoate, phenyl 1-hydroxy-2-naphthoate, methyl 1-hydroxy-2-naphthoate, diphenyl carbonate, guaiacol carbonate, dibenzyl terephthalate, dimethyl terephthalate, 1,4-dimethoxynaphthalene, 1,4-diethoxynaphthalene, 1,4-dibenzyloxynaphthalene, 1,2-diphenoxyethane, 1,2-bis(3-methylphenoxy)ethane, 1,2-bis(4-methylphenoxy)ethane, 1,4-diphenoxybutane, 1,4-diphenoxy-2-butene, 1,2-bis(4-methoxyphenylthio)ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy) benzene, p-(2-vinyloxyethoxy)biphenyl, p-propargyloxybiphenyl, dibenzoyloxymethane, dibenzoyloxypropane, dibenzyl disulfide, 1,1-diphenylethanol, 1,1-diphenylpropanol, p-(benzyloxy) benzyl alcohol, 1,3-phenoxy-2-propanol, N-octadecylcarbamoyl-p-methoxycarbonylbenzene, N-octadecylcarbamoylbenzene, 1,2-bis(4-methoxyphenoxy)-propane, 1,5-(4-methoxyphenoxy)-3-oxapentane, dibenzyl oxalate, bis(4-methylbenzyl)oxelate, and bis(4-chlorobenzyl)oxalate.

To provide the thermosensitive recording layer on the support, a mixture of the coloring agent, the color developer and the binder agent is uniformly dispersed or dissolved in water and/or an organic solvent to prepare a coating liquid for the thermosensitive recording layer. It is preferable that the above-mentioned constituent components be dispersed in the solvent until the particle size of dispersed particles reaches 10 μm or less, more preferably 5 μm or less, and further preferably 1 μm or less. The coating liquid thus prepared is coated on the support and dried, so that the thermosensitive recording layer was formed on the support. In this case, any conventional coating methods are usable.

The thickness of the thermosensitive recording layer, which depends on the formulation for the coating liquid of the recording layer and the application of the obtained thermosensitive recording adhesive label sheet, is in the range of about 1 to 50 μm, more preferably in the range of about 3 to 20 μm.

When necessary, the coating liquid for the thermosensitive recording layer may further comprise auxiliary additive components such as a filler, a surface active agent, a lubricant and an agent for preventing color formation by pressure application, which are used in the conventional thermosensitive recording materials, in order to improve the coating properties and the recording characteristics of the obtained thermosensitive recording layer.

Examples of the filler for use in the thermosensitive recording layer are finely-divided particles of inorganic pigments such as silica, zinc oxide, titanium oxide, aluminum hydroxide, zinc hydroxide, barium sulfate, clay, kaolin, talc, and surface-treated silica; and finely-divided particles of organic pigments such as urea—formaldehyde resin, styrene—methacrylic acid copolymer, polystyrene resin, vinylidene chloride resin, styrene—acrylic copolymer and minute void plastic particles.

In the present invention, a sheet of paper, that is, both of acidic paper and neutral paper, and a sheet of synthetic paper can be used for the material of the support.

When the neutral paper is used for the support and the disposable backing sheet, it is desirable to decrease the concentration of calcium in the support and the disposable backing sheet. To be more specific, it is preferable that the neutral paper comprising calcium at a concentration of 1,000 ppm or less be used for the disposable backing sheet and the support.

The calcium concentration in neutral paper can be controlled when the amount of paper materials made from used papers is drastically reduced in the course of the making of neutral paper. Further, neutral paper is commonly made using calcium carbonate as an internal additive and an alkyl ketene dimer or an alkenylsuccinic acid anhydride as a sizing agent. By exchanging calcium carbonate for talc or clay as the internal additive, and using a neutral rosin sizing agent in combination with the above-mentioned internal additive, the calcium concentration in the neutral paper can be decreased.

In the thermosensitive recording adhesive label sheet of the present invention, a protective layer is provided on the thermosensitive recording layer to improve the preservation stability of recorded images and upgrade the writing characteristics of the recording label sheet. Namely, the resistance to chemicals, water, abrasion and light, and the head-matching properties of the thermosensitive recording layer are improved by the provision of the protective layer, so that such a protective layer is considered to be an indispensable element for constructing a thermosensitive recording adhesive label sheet.

The protective layer for use in the present invention comprises a binder agent, a pigment and a lubricant.

Examples of the binder agent for use in the protective layer include a water-soluble resin, a hydrophobic resin, an ultraviolet curing resin and an electron-beam curing resin.

Specific examples of the water-soluble resin include polyvinyl alcohol, modified polyvinyl alcohol, cellulose derivatives such as methyl cellulose, methoxy cellulose and hydroxy cellulose, casein, gelatin, polyvinyl pyrrolidone, styrene—maleic anhydride copolymer, diisobutylene—maleic anhydride copolymer, polyacrylamide, modified polyacrylamide, methyl vinyl ether—maleic anhydride copolymer, carboxyl-modified polyethylene, polyvinyl alcohol—acrylamide block copolymer, melamine—formaldehyde resin, and urea—formaldehyde resin.

Specific examples of the resin for an aqueous emulsion or the hydrophobic resin include polyvinyl acetate, polyurethane, styrene—butadiene copolymer, styrene—butadiene—acryl copolymer, polyacrylic acid, polyacrylic ester, vinyl chloride—vinyl acetate copolymer, polybutyl methacrylate, polyvinyl butyral, polyvinyl acetal, ethyl cellulose, and ethylene—vinyl acetate copolymer. Copolymers prepared by combining the segments of the above-mentioned resins and a silicone segment are also preferably employed in the present invention. These resins can be used alone or in combination. When necessary, a curing agent may be added to these resins to cure the resins.

The ultraviolet curing resin is prepared by polymerizing a monomer or oligomer (or prepolymer) which is polymerizable to form a cured resin by the application of ultraviolet light thereto. There are no limitations on such a monomer or oligomer (or prepolymer), and conventional monomers and oligomers (or prepolymers) can be employed.

There are no particular limitations on the electron-beam curing resins for use in the present invention. For example, an electron-beam curing resin comprising a polyester skeleton with a five or more functional branched molecular structure, and a silicone-modified electron-beam curing resin are preferably employed.

In the present invention, the amount of an aliphatic acid metallic salt serving as a lubricant in the protective layer is decreased to 2 wt. % or less of the total solid content of the protective layer in order to minimize the occurrence of the interaction between the calcium ion migrating from the neutral paper and the aliphatic acid metallic salt contained in the protective layer.

With the above-mentioned points taken into consideration, the following lubricants are preferably employed in the protective layer: vegetable waxes such as candelilla wax, carnauba wax, rice bran wax, Japan wax and jojoba oil; animal waxes such as beeswax, lanolin and whale oil; mineral waxes such as ozokerite, montan wax and ceresin; petroleum waxes such as paraffin, vaseline, microcrystalline wax and petrolatum; synthetic hydrocarbon waxes such as Fischer-Tropsch wax, polyethylene wax and montanic acid ester; hydrogenated waxes such as hardened castor oil and derivatives thereof; and alkyl-modified silicone resin and amide-modified silicone resin. Those lubricants may be used in combination.

It is preferable that the amount of the lubricant for use in the protective layer be in the range of 0.5 to 40 wt. %, more preferably in the range of 1 to 10 wt. % of the total solid content of the protective layer.

With respect to the pigment for use in the protective layer, the same inorganic and organic pigments previously mentioned as the fillers for use in the thermosensitive recording layer can be employed.

The thermosensitive recording adhesive label sheet of the present invention may further comprise an intermediate layer which is provided between the support and the thermosensitive recording layer, and an undercoat layer which is provided between the support and the adhesive layer.

Each of the intermediate layer or the undercoat layer comprises the same binder agents and pigments as employed for the formation of the protective layer.

To avoid the occurrence of the interaction between calcium contained in the neutral paper and the aliphatic acid metallic salt contained in the protective layer, the protective layer may further comprise a calcium-ion-trapping agent. The calcium-ion-trapping agent for use in the present invention is an agent capable of reacting with a calcium ion migrating from the neutral paper for use in the disposable backing sheet and the support, and trapping the same.

It is effective that the previously mentioned thermosensitive recording layer, intermediate layer or undercoat layer further comprise such a calcium-ion-trapping agent.

The following materials can be used as the above-mentioned calcium-ion-trapping agents:

(1) A compound capable of bonding to calcium ion ($Ca^{2+}$) to produce a salt which is insoluble in water. For example, there can be employed salt compounds, each comprising an ion of sulfuric acid, silicic acid, phosphoric acid or tetraboric acid, and an ion of a metal such as Al, Na, Zn, Fe, Cu, Ni or Ti.

(2) A compound represented by formula of HOOC—R—COOH, in which R is an alkylene group or an aromatic ring, capable of forming a complex compound together with a calcium ion ($Ca^{2+}$). For example, there can be employed HOOC—$CH_2$—COOH, HOOC—$(CH_2)_2$—COOH, HOOC—$(CH_2)_7$—COOH and phthalic acid.

(3) A chelating agent capable of trapping a calcium ion ($Ca^{2+}$). For example, there can be employed an acetylacetone derivative, a crown ether derivative, triphosphine oxide, hexamethylenediamine, oxalate, and dialkyl glyoxime.

For the adhesive layer of the adhesive label sheet according to the present invention, any adhesives conventionally employed in this kind of label sheet are usable.

To record the image in the thermosensitive recording adhesive label sheet of the present invention, proper heating means, for example, a thermal pen, a thermal head, a laser beam or the like may be selected according to the application of the label sheet.

Other features of this invention will become apparent in the course of the following description of exemplary embodiments, which are given for illustration of the invention and are not intended to be limiting thereof.

EXAMPLE 1

[Formation of Intermediate Layer]

A mixture of the following components was stirred and dispersed, so that an intermediate layer coating liquid (1) was prepared:

| | Parts by Weight |
|---|---|
| Finely-divided spherical void particles (copolymer resin comprising styrene and acryl as the main components) (solid content: 27.5%, average particle size: 1 μm, and voidage: 50%) | 36 |
| Styrene-butadiene copolymer latex (solid content: 47.5%) | 10 |
| Water | 54 |

The thus prepared intermediate layer coating liquid (1) was coated on a sheet of acidic paper serving as a support, and dried so as to have a deposition amount of 3.0 g/m$^2$ on a dry basis, whereby an intermediate layer was provided on the support.

[Formation of Thermosensitive Recording Layer]

A mixture of the following components was separately pulverized in a porcelain ball mill for 2 days, so that a Liquid A, a Liquid B and a Liquid C were prepared:

| | Parts by Weight |
|---|---|
| (Liquid A) | |
| 3-dibutylamino-6-methyl-N-7-anilinofluoran | 20 |
| 10% aqueous solution of polyvinyl alcohol | 20 |
| Water | 60 |
| (Liquid B) | |
| 4-isopropoxy-4'-hydroxy diphenyl suulfone | 20 |
| 10% aqueous solution of polyvinyl alcohol | 25 |
| Water | 50 |
| (Liquid C) | |
| Silica | 20 |
| 5% aqueous solution of methyl cellulose | 20 |
| Water | 60 |

15 parts by weight of the Liquid A, 45 parts by weight of the Liquid B, 45 parts by weight of the Liquid C, and 5 parts by weight of a 20% alkaline aqueous solution of isobutylene—maleic anhydride copolymer were mixed to prepare a thermosensitive recording layer coating liquid (1). The thus prepared thermosensitive recording layer coating liquid (1) was coated on the intermediate layer, and dried as to have a deposition amount of 6.0 g/m$^2$ on a dry basis, whereby a thermosensitive recording layer was provided on the intermediate layer.

[Formation of Protective Layer]

A mixture of the following components was pulverized in a porcelain ball mill for 2 days, so that a Liquid D was prepared:

| (Liquid D) | Parts by Weight |
|---|---|
| Aluminum hydroxide | 20 |
| 10% aqueous solution of polyvinyl alcohol | 100 |
| Water | 80 |

A mixture of the following components was dispersed in a sand mill until the average particle size reached 4 μm or less, so that a lubricant dispersion (3) was prepared:

| (Lubricant Dispersion (3)) | Parts by Weight |
|---|---|
| Zinc Stearate (Trademark "SZ-1", made by Sakai Kagaku Kogyo K.K.) | 6.25 |
| Montan ester wax (Trademark "Wax-E", made by Hoechst Japan Limited) | 13.75 |
| 5% aqueous solution of methyl cellulose | 20 |
| Water | 60 |

190 parts by weight of the Liquid D, 10 parts by weight of the lubricant dispersion (3) and 5 parts by weight of a 12% aqueous solution of epichlorohydrin-modified polyacrylamide were mixed to prepare a protective layer coating liquid (3). The thus prepared protective layer coating liquid (3) was coated on the thermosensitive recording layer, and dried so as to have a deposition amount of 4.0 g/m$^2$ on a dry basis, so that a protective layer was provided on the thermosensitive recording layer.

The amount of the aliphatic acid metallic salt component was 2.0 wt. % of the total solid content of the obtained protective layer.

[Formation of Undercoat Layer]

190 parts by weight of the Liquid (D) and 5 parts by weight of a 12% aqueous solution of epichlorohydrin-modified polyacrylamide were mixed to prepare an undercoat layer coating liquid (1).

The thus prepared undercoat layer coating liquid (1) was coated on the back side of the support, opposite to the side of the thermosensitive recording layer with respect to the support, and dried so as to have a deposition amount of 3.0 g/m$^2$ on a dry basis, whereby an undercoat layer was provided on the back side of the support.

Then, the surface of the undercoat layer was surface-treated by supercalendering. An adhesive layer was provided on the undercoat layer, and a sheet of neutral paper with a calcium concentration of 1,200 ppm was attached to the adhesive layer.

Thus, a thermosensitive recording adhesive label sheet No. 1 according to the present invention was fabricated.

EXAMPLES 2 TO 18 AND COMPARATIVE EXAMPLES 1 TO 3

The procedure for fabrication of the thermosensitive recording adhesive label sheet No. 1 employed in Example 1 was repeated except that the material for the support, the formulations for the intermediate layer, the thermosensitive recording layer, the protective layer and the undercoat layer, and the material for the disposable backing sheet and the calcium concentration therein were changed as shown in Table 1.

Thus, thermosensitive recording adhesive label sheets No. 1 to No. 18 according to the present invention and comparative thermosensitive recording adhesive label sheets No. 1 to No. 3 were fabricated.

The formulation for each layer as indicated in Table 1 are as follows:

| | Parts by Weight |
|---|---|
| [Formulation for Intermediate Layer Coating Liquid (2)] | |
| Finely-divided spherical void particles (copolymer resin comprising styrene and acryl as the main components) (solid content: 27.5%, average particle size: 1 μm, and voidage: 50%) | 36 |
| Styrene-butadiene copolymer latex (solid content: 47.5%) | 10 |
| Calcium-ion trapping agent prepared by mixing oxalic acid and water at a ratio by weight of 10:90 (solid content: 10%) | 20 |
| Water | 34 |
| [(Formulation for Thermosensitive Recording Layer(2)] | |
| Liquid (A) | 15 |
| Liquid (B) | 45 |
| Liquid (C) | 45 |
| 20% alkaline aqueous solution of isobutylene-maleic anhydride copolymer | 5 |
| Calcium-ion trapping agent prepared by mixing oxalic acid and water at a ratio by weight of 10:90 (solid content: 10%) | 20 |

[Formulations for Protective Layer Coating Liquids (1), (2), (4) and (5)]

Prior to the preparation of the protective layer coating liquid, the following three kinds of lubricant dispersions (1), (2) and (4) were prepared in the same manner as in the preparation of the lubricant dispersion (3).

| | Parts by Weight |
|---|---|
| (Formulation for lubricant dispersion (1)) | |
| Zinc stearate (Trademark "SZ-1", made by Sakai Kagaku Kogyo K.K.) | 20 |
| 5% aqueous solution of methyl cellulose | 20 |
| Water | 60 |
| (Formulation for lubricant dispersion (2)) | |
| Zinc stearate (Trademark "SZ-1", made by Sakai Kagaku Kogyo K.K.) | 12.5 |
| Montan ester wax (Trademark "Wax-E", made by Hoechst Japan Limited) | 7.5 |
| 5% aqueous solution of methyl cellulose | 20 |
| Water | 60 |
| (Formulation for lubricant dispersion (4)) | |
| Montan ester wax (Trademark "Wax-E", made by Hoechst Japan Limited) | 20 |
| 5% aqueous solution of methyl cellulose | 20 |
| Water | 60 |

-continued

| | Parts by Weight |
|---|---|
| [Formulation for Protective Layer Coating Liquid (1)] | |
| Liquid (D) | 190 |
| Lubricant dispersion (1) | 10 |
| 12% aqueous solution of epichlorohydrin-modified polyacrylamide | 5 |

When a protective layer was provided using the above prepared protective layer coating liquid (1), the amount of the aliphatic acid metallic salt component was 6.4 wt. % of the total solid content of the obtained protective layer.

| [Formulation for Protective Layer Coating Liquid (2)] | |
|---|---|
| | Parts by Weight |
| Liquid (D) | 190 |
| Lubricant diapersion (2) | 10 |
| 12% aqueous solution of epichlorohydrin-modified polyacrylamide | 5 |

When a protective layer was provided using the above prepared protective layer coating liquid (2), the amount of the aliphatic acid metallic salt component was 4.0 wt. % of the total solid content of the obtained protective layer.

| [Formulation for Protective Layer Coating Liquid (4)] | |
|---|---|
| | Parts by Weight |
| Liquid (D) | 190 |
| Lubricant dispersion (3) | 10 |
| 12% aqueous solution of epichlorohydrin-modified polyacrylamide | 5 |
| Calcium-ion-trapping agent prepared by mixing oxalic acid and water at a ratio by weight of 10:90 | 20 |

When a protective layer was provided using the above prepared protective layer coating liquid (4), the amount of the aliphatic acid metallic salt component was 1.9 wt. % of the total solid content of the obtained protective layer.

| [Formulation for Protective Layer Coating Liquid (5)] | |
|---|---|
| | Parts by Weight |
| Liquid (D) | 190 |
| Lubricant dispersion (4) | 10 |
| 12% aqueous solution of epichlorohydrin-modified polyacrylamide | 5 |

When a protective layer was provided using the above prepared protective layer coating liquid (5), the amount of the aliphatic acid metallic salt component was 0 wt. % of the total solid content of the obtained protective layer.

[Formulation for Undercoat Layer Coating Liquid (2)]

| | Parts by Weight |
|---|---|
| Liquid (D) | 190 |
| 12% aqueous solution of epichlorohydrin-modified polyacrylamide | 5 |
| Calcium-ion-trapping agent prepared by mixing oxalic acid and water at a ratio by weight of 10:90 (solid content: 10%) | 20 |

TABLE 1

| | Support | Coating Liquid of [I]* | Coating Liquid of [T]** | Coating Liquid of [P]*** | Coating Liquid of [U]**** | Calcium Concentration of Backing Sheet |
|---|---|---|---|---|---|---|
| Ex. 1 | Acidic paper | (1) | (1) | (3) | (1) | 1200 ppm |
| Ex. 2 | Acidic paper | (1) | (1) | (5) | (1) | 1200 ppm |
| Ex. 3 | Acidic paper | (1) | (1) | (3) | (1) | 200 ppm |
| Ex. 4 | Acidic paper | (1) | (1) | (4) | (1) | 1200 ppm |
| Ex. 5 | Acidic paper | (1) | (2) | (3) | (1) | 1200 ppm |
| Ex. 6 | Acidic paper | (2) | (1) | (3) | (1) | 1200 ppm |
| Ex. 7 | Acidic paper | (1) | (1) | (3) | (2) | 1200 ppm |
| Ex. 9 | Neutral paper (Ca: 1200 ppm) | (1) | (1) | (3) | (1) | 1200 ppm |
| Ex. 9 | Neutral paper (Ca: 200 ppm) | (1) | (1) | (3) | (1) | 1200 ppm |
| Ex. 10 | Neutral paper (Ca: 200 ppm) | (1) | (1) | (3) | (1) | 200 ppm |
| Ex. 11 | Neutral paper (Ca: 1200 ppm) | (1) | (1) | (4) | (1) | 1200 ppm |
| Ex. 12 | Neutral paper (Ca: 1200 ppm) | (1) | (2) | (3) | (1) | 1200 ppm |
| Ex. 13 | Neutral paper (Ca: 1200 ppm) | (2) | (1) | (3) | (1) | 1200 ppm |
| Ex. 14 | Neutral paper (Ca: 1200 ppm) | (1) | (1) | (3) | (2) | 1200 ppm |
| Ex. 15 | Neutral paper (Ca: 200 ppm) | (1) | (1) | (4) | (1) | 1200 ppm |
| Ex. 16 | Neutral paper (Ca: 200 ppm) | (1) | (2) | (3) | (1) | 1200 ppm |
| Ex. 17 | Neutral paper (Ca: 200 ppm) | (2) | (1) | (3) | (1) | 1200 ppm |
| Ex. 18 | Neutral paper (Ca: 200 ppm) | (1) | (1) | (3) | (2) | 1200 ppm |
| Comp. Ex. 1 | Acidic paper | (1) | (1) | (1) | (1) | 1200 ppm |
| Comp. Ex. 2 | Acidic paper | (1) | (1) | (2) | (1) | 1200 ppm |
| Comp. Ex. 3 | Neutral paper (Ca. 1200 ppm) | (1) | (1) | (1) | (1) | 1200 ppm |

*(I): Intermediate layer
**(T): Thermosensitive recording layer
***(P): Protective layer
****(U): Undercoat layer (Preservation Stability Test 1)

Using each sample of the previously obtained thermosensitive recording adhesive label sheets Nos. 1 to 18 according to the present invention and comparative thermosensitive recording adhesive label sheets Nos. 1 to 3, preservation stability test (1) was conducted. To be more specific, a plurality of label sheet samples of the same kind was piled up in such a fashion that the disposable backing sheet of one sheet sample was brought into pressure contact with the protective layer of the neighboring sheet sample put thereunder. The pile of recording label sheet samples was allowed to stand at 50° C. and 95% RH for 15 hours under the above-mentioned condition.

Then, ink images were printed on the surface of each thermosensitive recording adhesive label sheet by using a commercially available printing tester "Model RI-2" (Trademark), made by Akira Seisakusho Co., Ltd., under the following conditions:

Ink: Gman ULP022 blue UV ink

Amount of ink: 1 cc

Ink-coating speed: 750 rpm

After the printing operation was completed, the ink was cured using an ultraviolet-light irradiation machine. Then, the image density of obtained ink images was measured by a Mcbeth reflection-type densitometer with a filter for measuring a density of a blue image.

The results are shown in Table 2.

(Preservation Stability Test 2)

Each of the thermosensitive recording adhesive label sheets was subjected to preservation stability test (2) by allowing each label sheet to stand at 40° C. and 90% RH for 15 hours.

Then, the density of a background portion of the label sheet was measured by a Mcbeth reflection-type densitometer before and after the storage.

The results are also shown in Table 2.

TABLE 2

| | Preservation Stability Test (1) Image Density | Preservation Stability Test (2) Background density before storage | Preservation Stability Test (2) Background density after storage |
|---|---|---|---|
| Ex. 1 | 1.82 | 0.09 | 0.11 |
| Ex. 2 | 1.95 | 0.09 | 0.11 |

TABLE 2-continued

| | Preservation | Preservation Stability Test (2) | |
|---|---|---|---|
| | Stability Test (1) Image Density | Background density before storage | Background density after storage |
| Ex. 3 | 1.97 | 0.09 | 0.11 |
| Ex. 4 | 1.93 | 0.10 | 0.13 |
| Ex. 5 | 1.89 | 0.10 | 0.14 |
| Ex. 6 | 1.88 | 0.10 | 0.13 |
| Ex. 7 | 1.88 | 0.10 | 0.13 |
| Ex. 8 | 1.82 | 0.09 | 0.10 |
| Ex. 9 | 1.88 | 0.08 | 0.10 |
| Ex. 10 | 1.90 | 0.09 | 0.10 |
| Ex. 11 | 1.91 | 0.10 | 0.11 |
| Ex. 12 | 1.88 | 0.11 | 0.12 |
| Ex. 13 | 1.86 | 0.10 | 0.11 |
| Ex. 14 | 1.97 | 0.10 | 0.11 |
| Ex. 15 | 1.93 | 0.1Q | 0.11 |
| Ex. 16 | 1.90 | 0.11 | 0.12 |
| Ex. 17 | 1.87 | 0.10 | 0.11 |
| Ex. 18 | 1.88 | 0.10 | 0.11 |
| Comp. Ex. 1 | 0.80 | 0.09 | 0.12 |
| Comp. Ex. 2 | 1.42 | 0.09 | 0.12 |
| Comp. Ex. 3 | 0.56 | 0.09 | 0.11 |

Understandably, therefore, when the amount of the aliphatic acid metallic salt component for use in the protective layer is decreased to 2 wt. % or less of the total solid content of the protective layer, the image density of the printed images is sufficiently high, so that deterioration of the printing characteristics can be prevented after the storage.

Japanese Patent Application 07-243015 filed Sep. 21, 1995; Japanese Patent Application 07-281580 filed Oct. 30, 1995; and Japanese Patent Application 08-244862 filed Sep. 17, 1996 are hereby incorporated by reference.

What is claimed is:

1. A thermosensitive recording adhesive label sheet comprising:

(i) a support, (ii) a thermosensitive recording layer provided on the front side of said support, comprising a leuco dye serving as a coloring agent and a color developer capable of inducing color formation in said leuco dye upon application of heat thereto, (iii) a protective layer provided on said thermosensitive recording layer, comprising a binder agent, a pigment a calcium-ion-trapping agent and a lubricant comprising an aliphatic acid metallic salt, (iv) an adhesive layer provided on the back side of said support, opposite to the side of said thermosensitive recording layer with respect to said support, and (v) a disposable backing sheet attached to said adhesive layer, comprising a neutral paper, with said protective layer comprising said aliphatic acid metallic salt in an amount of 2 wt % or less of the total solid content of said protective layer, wherein said calcium-ion-trapping agent is capable of trapping calcium ion which migrates from said disposable backing sheet to said protective layer.

2. The thermosensitive recording adhesive label sheet as claimed in claim 1, wherein said neutral paper for use in said disposable backing sheet comprises calcium at a concentration of 1,000 ppm or less.

3. The thermosensitive recording adhesive label sheet as claimed in claim 1, further comprising an intermediate layer which is provided between said support and said thermosensitive recording layer.

4. The thermosensitive recording adhesive label sheet as claimed in claim 3, wherein said intermediate layer comprises a calcium-ion-trapping agent capable of trapping calcium ion which migrates from said disposable backing sheet to said protective layer.

5. The thermosensitive recording adhesive label sheet as claimed in claim 1, wherein said thermosensitive recording layer further comprises a calcium-ion-trapping agent capable of trapping calcium ion which migrates from said disposable backing sheet to said protective layer.

6. The thermosensitive recording adhesive label sheet as claimed in claim 1, further comprising an undercoat layer which is provided between said support and said adhesive layer.

7. The thermosensitive recording adhesive label sheet as claimed in claim 6, wherein said undercoat layer comprises a calcium-ion-trapping agent capable of trapping calcium ion which migrates from said disposable backing sheet to said protective layer.

8. The thermosensitive recording adhesive label sheet as claimed in claim 1, wherein said support comprises a neutral paper.

9. The thermosensitive recording adhesive label sheet as claimed in claim 8, wherein said neutral paper for use in said support comprises calcium at a concentration of 1,000 ppm or less.

10. The thermosensitive recording adhesive label sheet as claimed in claim 9, further comprising an intermediate layer which is provided between said support and said thermosensitive recording layer.

11. The thermosensitive recording adhesive label sheet as claimed in claim 6, wherein said intermediate layer comprises a calcium-ion-trapping agent capable of trapping calcium ion which migrates from said disposable backing sheet and said support to said protective layer.

12. The thermosensitive recording adhesive label sheet as claimed in claim 9, wherein said thermosensitive recording layer further comprises a calcium-ion-trapping agent capable of trapping calcium ion which migrates from said disposable backing sheet and said support to said protective layer.

13. The thermosensitive recording adhesive label sheet as claimed in claim 9, further comprising an undercoat layer which is provided between said support and said adhesive layer.

14. The thermosensitive recording adhesive label sheet as claimed in claim 13, wherein said undercoat layer comprises a calcium-ion-trapping agent capable of trapping calcium ion which migrates from said disposable backing sheet and said support to said protective layer.

* * * * *

UNITED STATES PATENT AND TRADEMARK OFFICE

CERTIFICATE OF CORRECTION

PATENT NO. : 5,827,590

DATED : October 27, 1998

INVENTOR(S) : Mitsunobu MORITA ET AL.

It is certified that error appears in the above-identified patent and that said Letters Patent is hereby corrected as shown below:

Column 15, table 2, example 14 "1.97" should read --1.87--.

Column 15, table 2, example 15 "0.1Q" should read --0.10--.

Column 16, line 41, "Claim 6" should read --Claim 10--.

Signed and Sealed this

Nineteenth Day of September, 2000

*Attest:*

Q. TODD DICKINSON

*Attesting Officer*

*Director of Patents and Trademarks*